United States Patent [19]

Meives et al.

[11] Patent Number: 4,589,812

[45] Date of Patent: May 20, 1986

[54] METHOD OF AND APPARATUS FOR STACKING REAMS OF PAPER SHEETS

[75] Inventors: Otis E. Meives, Cleveland; James W. Lewandoske, Sheboygan, both of Wis.

[73] Assignee: Pemco, Inc., Sheboygan, Wis.

[21] Appl. No.: 543,084

[22] Filed: Oct. 18, 1983

[51] Int. Cl.[4] ..... B65G 57/10

[52] U.S. Cl. ..... 414/46; 198/430; 198/740; 414/68; 414/89; 414/98; 414/786

[58] Field of Search ..... 414/43, 46, 68, 89, 414/98, 100, 114, 786; 198/430, 740

[56] References Cited

U.S. PATENT DOCUMENTS

| | | | |
|---|---|---|---|
| 2,080,858 | 5/1937 | Dorman | 198/430 |
| 2,648,181 | 8/1953 | Dalton | 414/46 X |
| 2,738,116 | 3/1956 | Barraclough | 414/68 X |
| 2,796,179 | 6/1957 | Van Vleck | 414/46 X |
| 2,808,921 | 10/1957 | Knowles | 198/430 |
| 3,028,979 | 4/1962 | Zachow | 414/82 |
| 4,354,786 | 10/1982 | Spitler | 414/46 |

FOREIGN PATENT DOCUMENTS

| | | | |
|---|---|---|---|
| 3114328 | 10/1982 | Fed. Rep. of Germany | 414/114 |
| 646172 | 9/1962 | Italy | 414/43 |

*Primary Examiner*—Leslie J. Paperner

*Attorney, Agent, or Firm*—Peter K. Kontler

[57] ABSTRACT

A method and an apparatus for accumulating reams of paper sheets into stacks. A file of reams is fed by the upper reach of a belt conveyor which is flanked by a shifting arm and an elevator platform. The arm is caused to move transversely of the conveyor and the delivery of succeeding reams can continue without awaiting retraction of the shifting mechanism. The reams are accumulated in the stacking region on an elevator mechanism and are raised by the elevator mechanism to a delivery position above the receiving position after a desired number of reams have been accumulated on the elevator mechanism. The accumulated reams are removed from the elevator mechanism at the delivery position and the elevator mechanism is lowered back to the receiving position after the accumulated reams have been removed, without awaiting retraction of the removing mechanism.

26 Claims, 7 Drawing Figures

METHOD OF AND APPARATUS FOR STACKING REAMS OF PAPER SHEETS

BACKGROUND OF THE INVENTION

The present invention relates to a method of and to an apparatus for accumulating piles of sheets of paper or the like. More particularly, the invention relates to a method and apparatus for stacking reams of paper, and for transporting the stacks on to a further processing station.

The invention is directed particularly to the accumulation of piles of sheets of paper, such as reams of 8½" by 11" sheets of paper wrapped in heavy paper (500 sheets constituting a ream). Such reams are presently produced in vast quantities by means of an apparatus called a "sheeter" which cuts rolls of paper into sheets of the desired size (e.g., 8½" by 11") and stacks the sheets in piles of 500 sheets and an apparatus called a "ream wrapper" which wraps the piles in a sheet of wrapping paper. The wrapped reams are fed into cartons which are closed with lids as generally described in U.S. Pat. No. 4,117,646. The reams are packed in the cartons in stacks. The reams can be accumulated into such stacks in the cartons themselves as disclosed in U.S. Pat. No. 4,150,523 or they can be accumulated into stacks prior to insertion into the cartons.

A problem presently confronting the industry is how to increase the speeds of the accumulating and cartoning apparatus so as to handle the increased numbers of wrapped reams being turned out by improved, high speed sheeters and ream wrappers.

One apparatus presently employed involves bottom feed accumulation or upstacking of piles. The piles are delivered to an elevator which then serially raises them until they are engaged and supported by dogs which grasp the undersides of the lowermost piles about their edges. The elevator is then lowered to its original position to receive other piles and the dogs continue to hold the preceeding piles. When the elevator receives succeeding piles, it lifts those piles which in turn contact and lift piles already being held by the dogs. The dogs thus engage the undersides of the most recently elevated or lowermost piles. This apparatus is unable to handle high volumes because of wasted idle motion and provides unacceptable support for the piles, particularly when operating at high speeds.

OBJECTS AND SUMMARY OF THE INVENTION

An object of the invention is the provision of novel and unique method and apparatus for continuously accumulating piles of sheets of paper into stacks with minimum interruption or delay due to idle return strokes.

Another object of the invention is the provision of novel and unique method and apparatus for simultaneously accumulating two or more stacks of piles of sheets of paper which can be rapidly converted for stacking of piles of wider, narrower, longer of shorter sheets of paper.

An additional object of the invention is the provision of novel and unique method and apparatus with means for temporary storage of piles of sheets on their way to a stacking elevator.

A further object of the invention is the provision of novel and unique method and apparatus for continuing to receive further piles of sheets of paper without waiting for indexing means which is in the process of shifting preceding piles onto a stack elevator to return to its original position.

An additional object of the invention is the provision of novel and unique method and apparatus with means for operating the moving parts in a predetermined sequence to ensure that accumulation of stacks takes up as little time as possible.

A still further object of the invention is the provision of novel and unique method and apparatus for removing accumulated stacks from the stacking elevator.

Another object of the invention is the provision of novel and unique method and apparatus for operating the stacking elevator to ensure that the accumulation of stacks requires as little of idle elevator motion as possible.

An additional object of the invention is the provision of novel and unique method and apparatus for returning the stacking elevator to its first receiving position where it can receive succeeding piles without waiting for the means which is in the process of removing stacks from the elevator to return to its original position.

The invention is embodied in method and apparatus for accumulating piles of sheets into larger stacks, particularly for accumulating reams of paper, such as reams of 8½" by 11" sheets of paper (a ream consisting of 500 sheets of paper) into larger stacks.

The method comprises seriatim feeding of piles of sheets into a holding station, shifting a select number of the piles from the holding station onto an elevator mechanism at a receiving position in a stacking region, moving the elevator mechanism incrementally downward to succeeding receiving positions spaced below the first receiving position through distances approximately equal to the height of the piles being stacked, rotating the shifting or indexing mechanism out of the path of succeeding piles during its return stroke so that succeeding piles can be delivered to the holding station without awaiting completion of return of the shifting or indexing mechanism, reversing the direction of the elevator mechanism after a desired number of piles are accumulated in stacks and raising the elevator mechanism to a delivery position above the first receiving position, removing the stacks of accumulated piles from the elevator mechanism at the delivery position and lowering the elevator mechanism back to the first receiving position after such removal is completed without awaiting retraction of the removing mechanism.

The apparatus comprises a feed conveyor for seriatim delivery of reams of paper which have been cut and stacked by a "sheeter" and then wrapped by a "ream wrapper". Piles of sheets of paper delivered by the feed conveyor are shifted by an indexing mechanism onto an accumulating or stacking elevator. The indexing mechanism comprises an indexing arm which engages the side of each pile of sheets which is substantially parallel to the path of movement of the piles and remote from the elevator and pushes against such side to urge the pile onto the elevator. The underside of the indexing arm which is generally parallel to and faces the first conveyor is undercut so that piles can be delivered beneath the indexing arm during the retraction stroke of the indexing arm. The empty elevator receives piles in a first receiving position and subsequently moves downwardly through distances approximately equal to the height of the piles being accumulated to succeeding receiving positions where additional piles are accumulated on top of piles already on the elevator until the elevator accumulates the desired number of piles into desired larger stacks, at which point further movement of the elevator is detected by monitoring means and a signal which is generated by the monitoring means causes the drive for the elevator to reverse such that the elevator moves upwardly to a delivery position which is above the first receiving position. Removing means is provided for removing the larger stacks of sheets from the elevator onto a storage conveyor when the elevator is in the delivery position. The movement of the removing means is monitored by monitoring means such that upon completion of sufficient movement of the removing means to effect removal of the stacks from the elevator, the drive means for the elevator is activated by a signal from the monitoring means such that the elevator again moves downwardly to the first receiving position prior to the return stroke of the removing means. An accumulator plate which is coplanar with the upper reaches of the feed conveyor is provided at the discharge end of the feed conveyor for accumulating piles of sheets prior to shifting by the indexing arm onto the elevator. In this manner, the indexing arm can effect simultaneous delivery to the elevator of multiple piles of sheets. Monitoring means is provided for monitoring the number of piles on the accumulator plate and for actuating drive means for the indexing mechanism when the desired number of piles of sheets is detected on the accumulator plate.

The novel features which are considered as characteristic of the invention are set forth in particular in the appended claims. The improved method and apparatus, however, both as to their construction and mode of operation, together with additional features and advantages thereof, will be best understood upon perusal of the following detailed description of certain specific embodiments with reference to the accompanying drawing.

BRIEF DESCRIPTION OF THE DRAWING

Corresponding reference characters indicate corresponding parts throughout the several views of the drawings. In FIG. 3, prime numbers are used to indicate corresponding parts shown with phantom lines in different positions.

DESCRIPTION OF THE PREFERRED EMBODIMENTS

Figure 1:
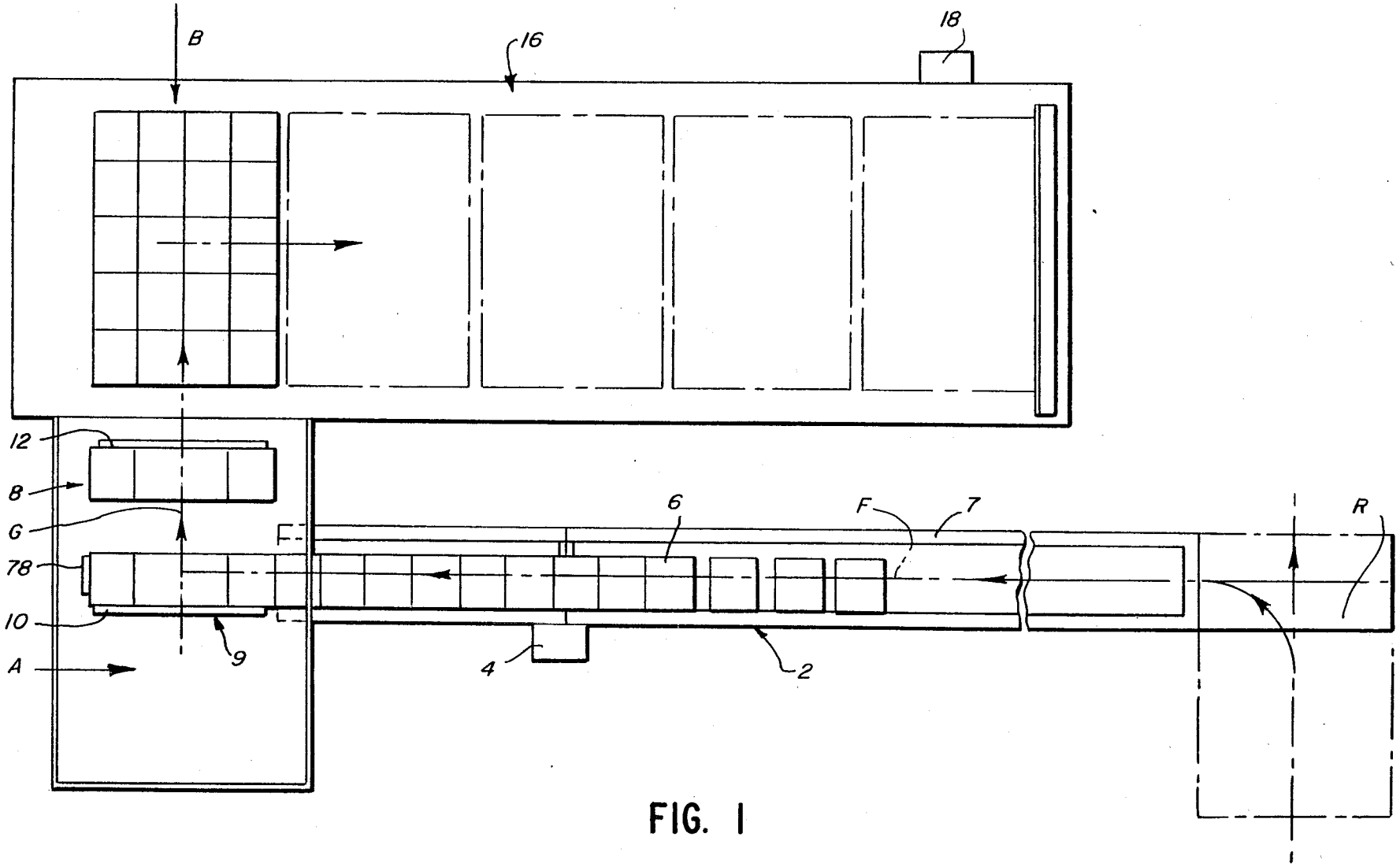
FIG. 1 is a schematic plan view of an apparatus which embodies the invention.

Referring first to FIG. 1, there is shown an apparatus which serves to accumulate discrete piles 6 of sheets (i.e., reams of overlapping sheets consisting of paper or the like) into larger groups (hereinafter called stacks). The apparatus comprises a conventional feed conveyor 2 which receives a single file of reams 6 from a ream wrapper R. The reams 6 from the ream wrapper R are carried on one or more endless flexible elements or belts 7 which constitutes or constitute component parts of the conveyor 2 and whose upper reach or reaches advance in the direction indicated by arrow F. The feed conveyor 2 is intermittently driven by a drive 4. The reams 6 are discharged by the feed conveyor 2 in front of an indexing or shifting mechanism 9. The indexing mechanism 9 has an indexing finger 10 which shifts the reams 6 onto an elevator (shown in FIG. 2) at a ream stacking station 8. The indexing finger 10 engages one of those sides of each ream 6 which are generally parallel to the path of movement of the reams on the feed conveyor 2, namely that side which is remote from the ream stacking station 8, and the finger 10 shifts the reams 6 in the direction of arrow G onto the elevator and into abutting engagement with a stop member 12. The elevator moves incrementally downward as reams are deposited thereon to thus accumulate stacks of reams. When a desired number of reams are accumulated on the elevator, the elevator reverses and moves upwardly to a delivery position above the first receiving position where the stacks of reams are shifted off the elevator in the same direction indicated by arrow G onto a storage conveyor 16. The storage conveyor is intermittently driven by a drive 18. The storage conveyor 16 remains stationary while a desired number of rows of stacks are shifted onto it, each succeeding row of stacks pushing the preceding row of stacks further onto the storage conveyor. When the desired number of rows of stacks are accumulated on the storage conveyor 16, the storage conveyor is advanced by the drive means 18.

Figure 2:
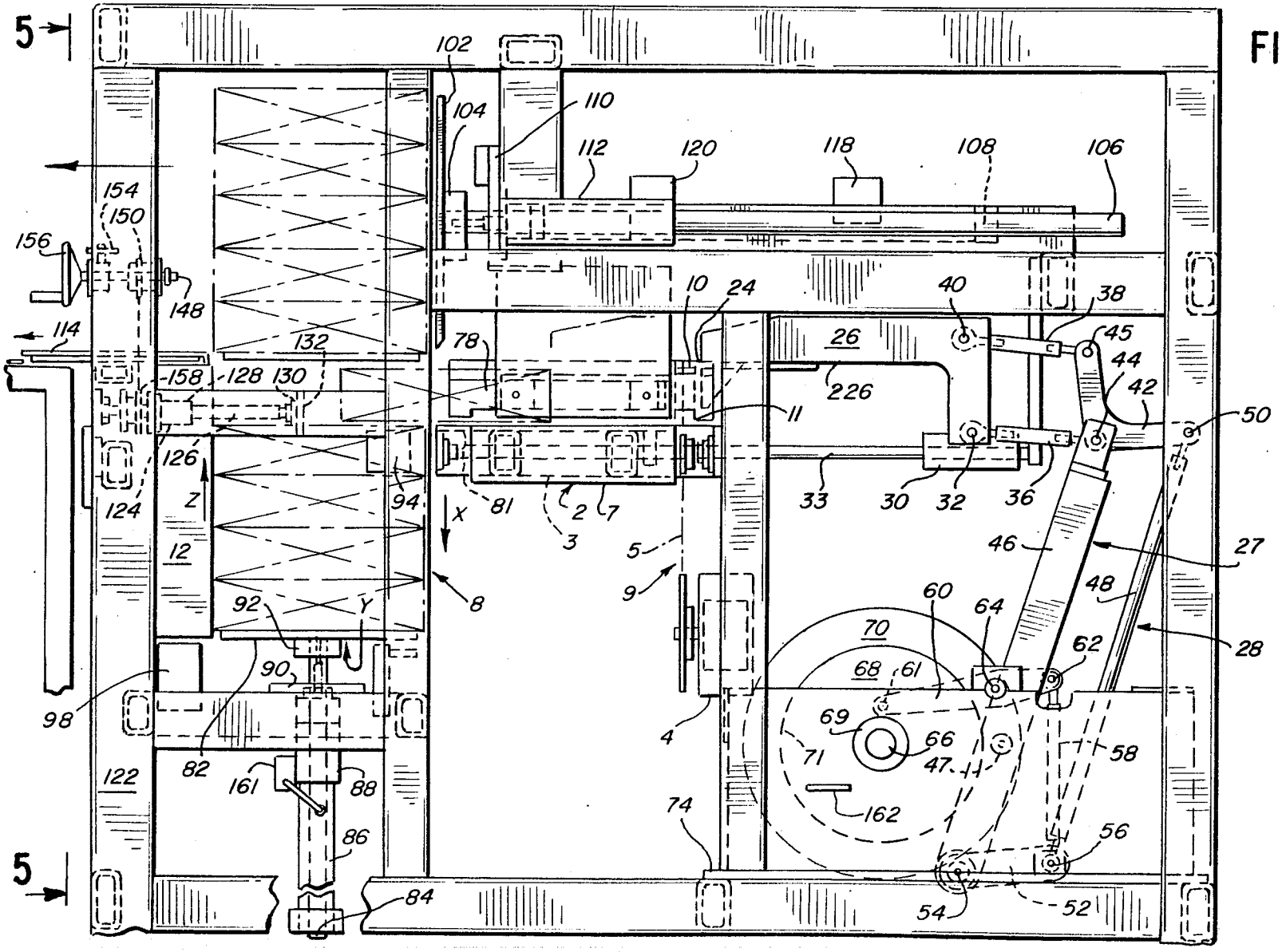
FIG. 2 is a side elevational view of the feed conveyor, shifting or indexing mechanism, elevator and removing means of the apparatus of FIG. 1, looking in the direction of arrow A in FIG. 1.

FIG. 2 shows a flexible element or belt 7 of the feed conveyor 2 trained over pulleys 3 (only one of which is shown in FIG. 2). The pulley 3 is intermittently driven by the drive 4 through the medium of a chain or belt 5.

Figures 3, 4:
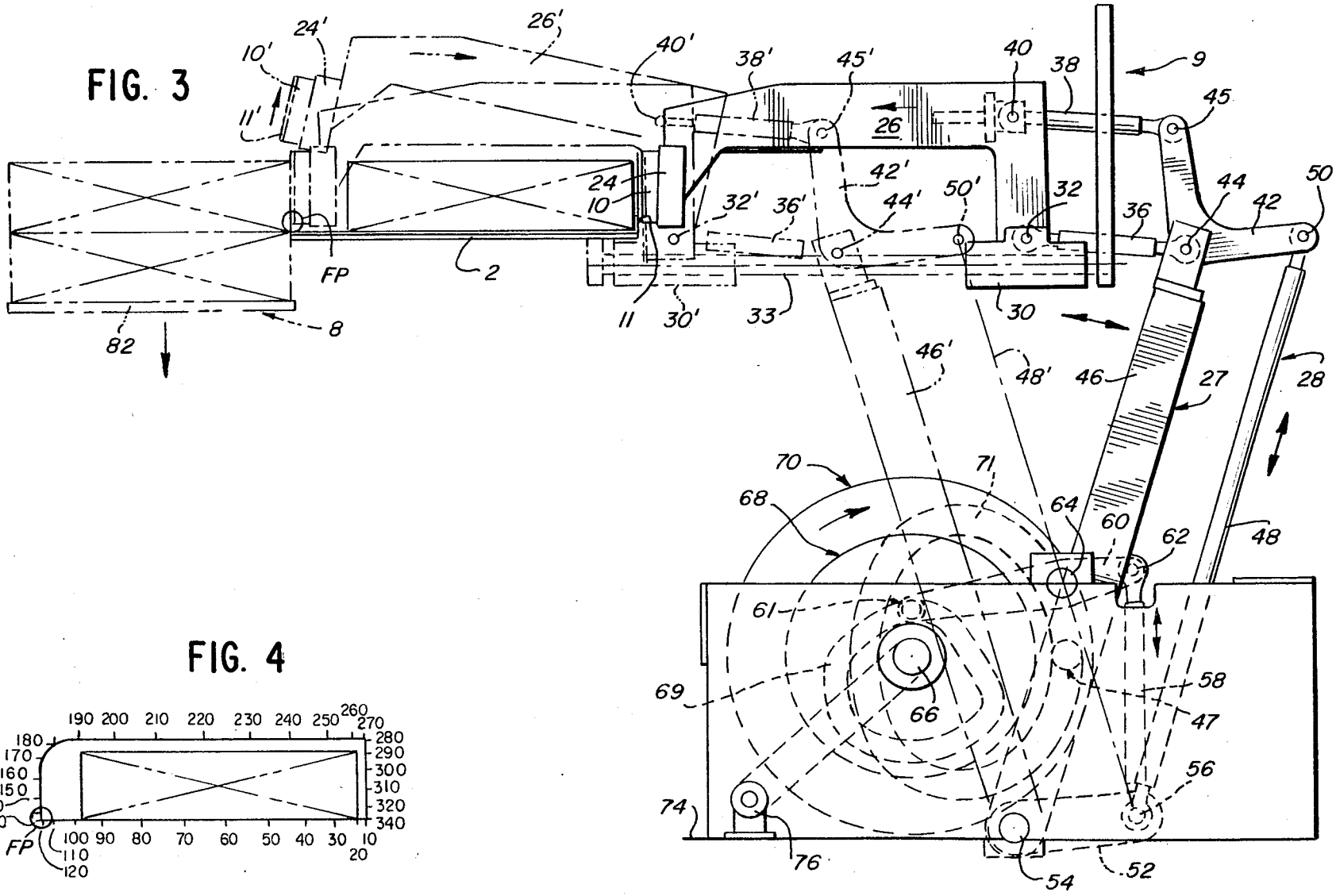
FIG. 3 is an enlarged side elevational view of the indexing mechanism of FIG. 2 showing the indexing arm in various positions.
FIG. 4 is a graph of the movement of the leading edge of the indexing finger of the indexing arm of FIG. 3 plotted over the 360 degree cycle of the transfer and lifting cam means which control movement of the indexing arm.

The components of the shifting or indexing mechanism 9 are shown in FIGS. 2 and 3. In FIG. 3, the indexing mechanism is shown by solid lines in its retracted position and by phantom lines in its fully extended and rotated position. Prime numbers are used to denote those elements of the indexing mechanism 9 which are shown by phantom lines and correspond to the elements shown by solid lines. The indexing mechanism 9 comprises an indexing arm 26 mounted for reciprocating horizontal movement and rotational movement. The indexing finger 10 is carried on a support 24 attached to one end of the indexing arm 26. The other end of the indexing arm 26 is pivotally mounted by means of a pivot pin 32 on a bearing block 30, which in turn is slidably mounted on a guide rod 33. The underside 226 of indexing arm 26 is cut out to facilitate continuous delivery of reams during the retraction stroke of the indexing arm 26 as will be more fully explained hereinbelow. The indexing arm 26 is driven by a drive linkage 27 connecting the indexing arm 26 to a transfer cam 70 and is rotated about the pivot pin 32 by a rotating linkage 28 connected to a lift cam 68.

The drive linkage 27 comprises an indexing drive rod 36 and an indexing cam lever 46. The indexing drive rod 36 is connected at one end to the pivot pin 32 and is articulately connected at the other end to one end of the cam lever 46 by means of a pin 44. The cam lever 46 is connected at its other end by a pivot shaft 54 to a frame or mount 74 for rotational movement about the axis of the shaft 54. A cam follower or pin 47 is mounted on the cam lever 46 intermediate its ends. The cam follower or pin 47 rides in a track 71 of the cam 70. The cam 70 is mounted for rotational movement about the axis of a shaft 66. The shaft 66 is intermittently driven by a hydraulic motor 76. During each complete revolution of the cam 70, movement of the cam follower or pin 47 in the track 71 causes the cam lever 46 to rotate first counterclockwise and thereafter clockwise about the axis of the shaft 54 such that drive rod 36 causes the indexing arm 26 to move first horizontally to the left as seen in FIGS. 2 and 3 with the pivot pin 32 attached to the bearing block 30 sliding horizontally along the guide rod 33 and thereafter horizontally back to the right with the pivot pin 32 mounted on the block 30 sliding on the guide rod 33 and retracing its original motion and returning to its original starting position.

The rotating linkage 28 comprises a raise rod 38, a raise crank 42, a raise rod 48, an idler lever 52, a cam rod 58 and a cam lever 60. The raise rod 38 is pivotally connected at one end by means of a pin 40 to the indexing arm 26 and its other end is pivotally connected by means of a pin 45 to the raise crank 42. The raise crank 42 is L-shaped and its apex, i.e., the junction of its base and arm, is connected to the drive rod 36 and to the cam lever 46 by means of the pin 44. The other end of the raise crank 42 is connected by means of a pin 50 to one end of the raise rod 48. The other end of the raise rod 48 is connected by means of a pin 56 to one end of the cam rod 58 and to one end of the idler lever 52. The other end of the cam rod 58 is connected by means of a pin 62 to the cam lever 60 and the other end of the idler lever 52 is mounted on the shaft 54 for rotational movement independently of the cam lever 46. The cam lever 60 is fulcrumed in the frame or mount 74 on a shaft 64 at a point offset from midway between its ends. The other end of the cam lever 60 carries a cam follower or pin 61. The cam follow or pin 61 rides in a track 69 of the lift cam 68. The lift cam 68 is mounted for rotational movement about the axis of the shaft 66 in unison with the transfer cam 70. Rotational movement of the lift cam 68 and concomitant movement of the cam follower or pin 61 in the track 69 causes the front edge 11 of the indexing finger 10 to move in the manner depicted in FIG. 4.

FIG. 4 shows that, during initial advancing movement of the indexing arm 26 horizontally to the left as seen in FIGS. 2 and 3, there is no rotational component of motion imparted to the indexing arm by the rotating linkage 28. However, upon completion of the advancing stroke of the indexing arm 26 and upon initiation of the return stroke, the rotating linkage 28 moves as a result of travel of the cam follower or pin 61 in the track 69 such that the indexing arm 26 is caused to pivot about the axis of the pin 32 whereby, during the return stroke, the leading edge 11 of the indexing finger 10 is raised above the level of the incoming reams 6 such that delivery of incoming reams 6 can continue during the return stroke of the indexing arm 26.

Figure 6:
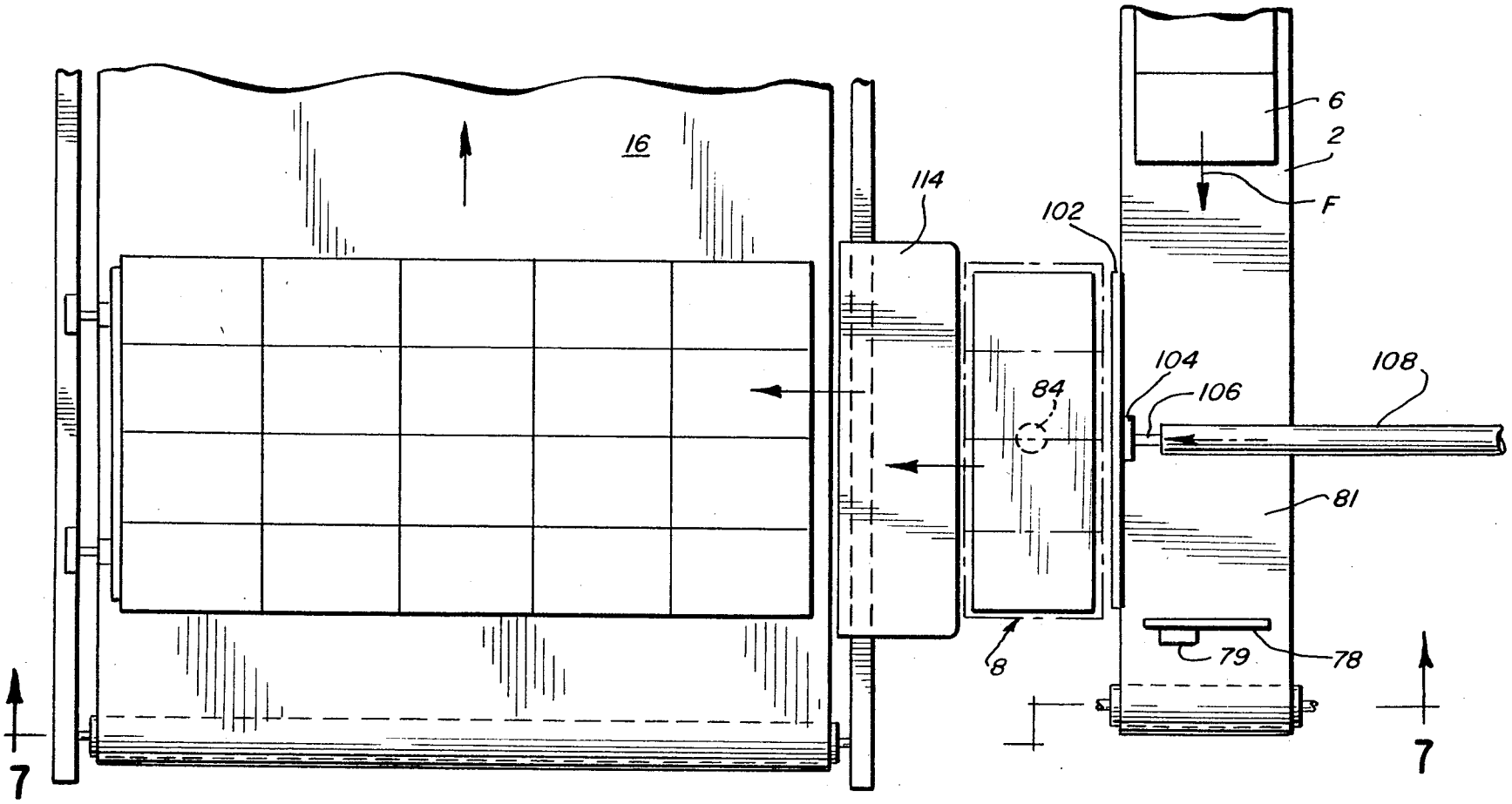
FIG. 6 is an enlarged fragmentary plan view of the elevator, pusher plate and storage conveyor of the apparatus of FIG. 1.

As seen in FIG. 6, as the reams 6 are delivered by the feed conveyor 2 they are free to move in the direction of arrow F until they abut a stop plate 78. The reams 6 are discharged from the feed conveyor 2 and deposited on an accumulator plate 81. The first ream 6 deposited on the accumulator plate 81 will come to rest at a point in close proximity to the discharge end of the feed conveyor 2. The next and succeeding reams 6 will, when discharged from the feed conveyor 2 onto the plate 81, engage the reams already on the plate 81 and push them further on the plate 81 until such time as a sufficient number of reams are accumulated on the plate 81 and the leading ream abuts against the stop plate 78. Monitoring means 79 in the form of a contact switch is installed in the stop plate 78 at a level below the top sheet of each ream such that the abutment of the leading ream against the stop plate 78 will cause the contact switch to close. Closure of the contact switch 79 initiates rotation of lift and transfer cams 68 and 70 thereby causing the indexing arm 26 under the action of the drive and rotating linkages 27 and 28 to advance the indexing finger 10 so as to shift reams accumulated on the plate 81 in front of the indexing finger 10 onto the elevator at the ream stacking station 8. During such shifting, reams 6 are continuously delivered by the feed conveyor 2. The indexing arm 26 shifts the reams on the plate 81 onto the elevator before the next-following ream is discharged by the conveyor 2. The next-following ream delivered by the conveyor 2 is discharged onto the plate 81 when the indexing arm 26 has completed its advancing stroke such that positioning of the ream on the plate 81 is not interfered with by the indexing arm 26 due to the cutout in the underside 226. The ream 6 is able to move below the indexing arm 26. Subsequently, as seen in FIG. 3, during retraction of the indexing arm 26 the latter moves upwardly so that it does not contact the next leading ream which is then already positioned on the plate 81.

The elevator at the ream stacking station 8 is shown in FIG. 2. The elevator comprises a plate or plateform 82 mounted on a guide rod 84. The rod 84 is driven upwardly and downwardly by a hydraulic motor 86. The hydraulic motor is mounted within a bearing bracket 88 and is attached to a support 90. A support 92 is provided for the guide rod 84. The elevator plate 82 cycles between a first receiving position vertically aligned with the plate 81 (shown by phantom lines in FIGS. 2 and 7) and succeeding receiving positions incrementally spaced downwardly from the first receiving position by distances approximately equal to the heights of the reams being handled, in the direction of arrow X. Monitoring means in the form of a transmission type photocell 94 is installed at a level in the ream stacking station 8 to detect the delivery of reams onto the elevator. The photocell 94 transmits signals on detection of the delivery of a ream onto the elevator to the reversible drive means (hydraulic motor 86) for the elevator, actuating the drive means so as to cause the plate 82 to move downwardly to the next succeeding receiving position. Additional monitoring means in the form of a limit switch 98 is installed at a level below the lowermost receiving position. The limit switch 98 detects the movement of the elevator plate 82 below the lowermost receiving position as a result of downward motion of the elevator plate 82. The signal from the limit switch 98 reverses the drive means 86 for the elevator as denoted by arrow Y, causing the elevator plate 82 to move upwardly in the direction of arrow Z to a delivery position shown by phantom lines in FIG. 2 and by solid lines in FIG. 7. There is also a counter that will count the layers placed on the elevator plate 82 so as to control the stack size by count rather than height.

Figure 5:
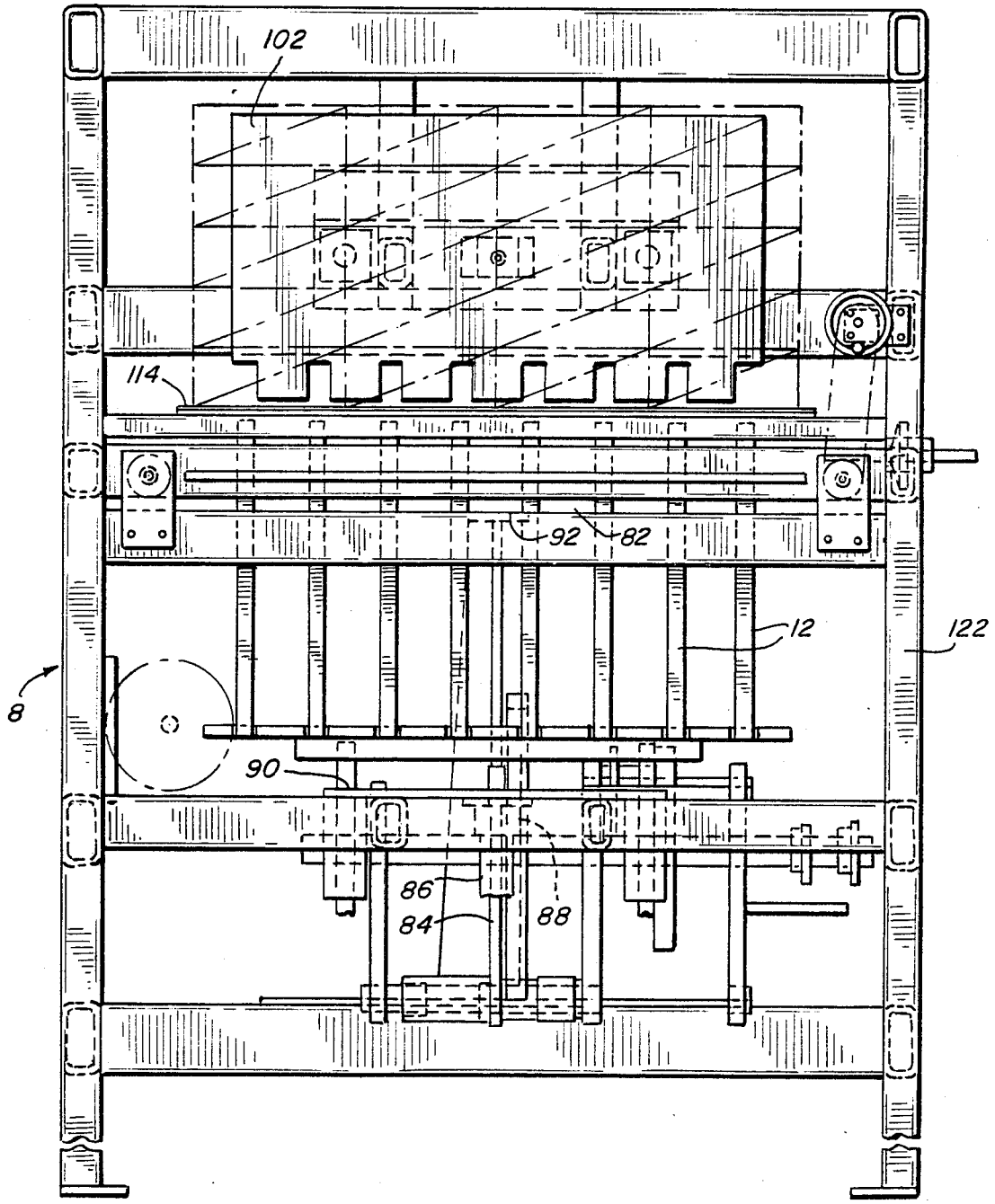
FIG. 5 is an elevational view of the pusher plate and elevator of the apparatus of FIG. 1, looking in the direction of arrow B in FIG. 1 and as seen in the direction of arrows from the line 5—5 of FIG. 2.
Figure 7:
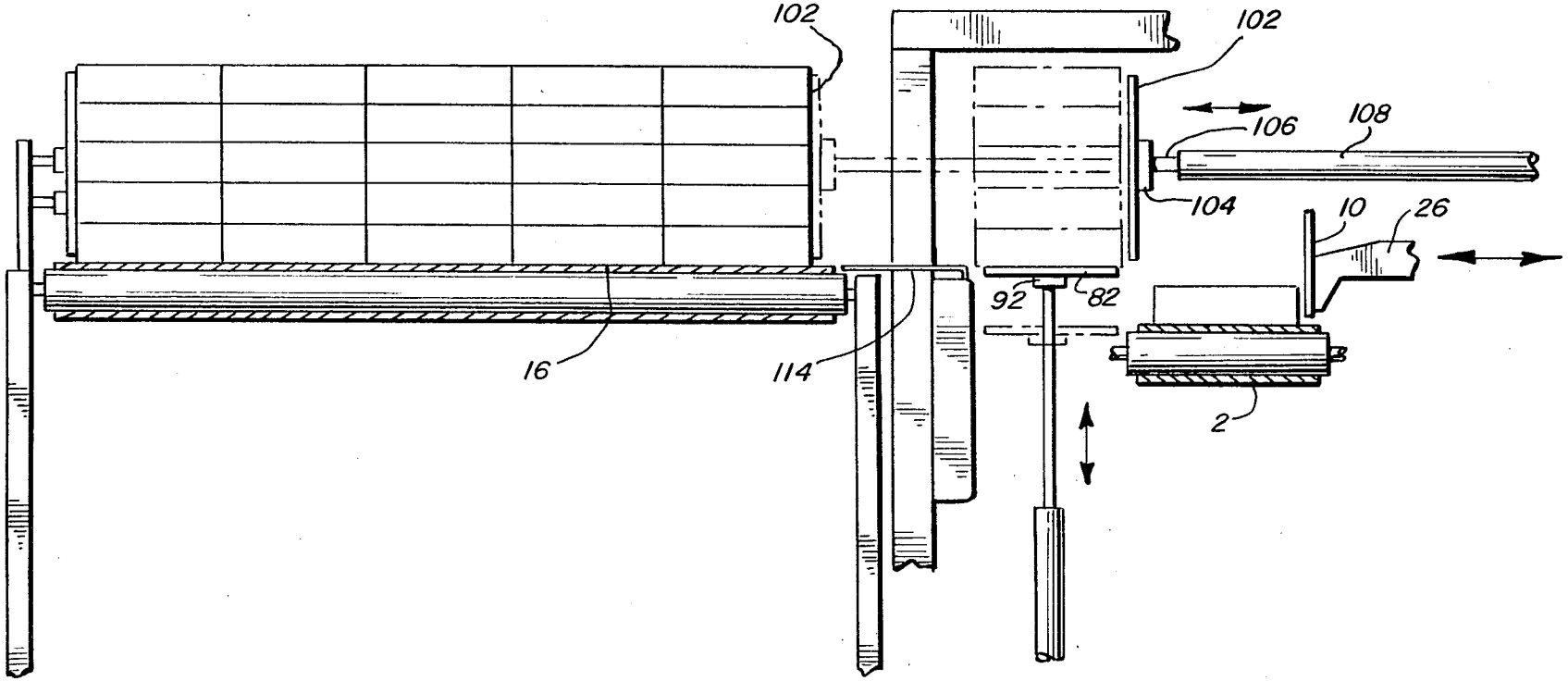
FIG. 7 is a vertical sectional view as seen in the direction of arrows from the line 7—7 of FIG. 6.

The elevator plate 82 in the delivery position is vertically aligned with a transfer plate 114. The signal from a limit switch 161, actuated by the guide rod 84 when the elevator plate 82 reaches the delivery position, actuates the drive for a pusher plate 102 (details of which are seen in FIGS. 5, 6 and 7), causing it to engage those sides of the stacks 6 which are remote from the transfer plate 114 and to move the stacks onto the plate 114. The pusher plate 102 is connected to a shaft 106 driven by a hydraulic cylinder and piston unit 108. Supports 110 and 112 are provided for the hydraulic cylinder and piston unit 108 and a support 104 is provided for the shaft 106. A switch plate or mount 118 is attached for coextensive movement with the pusher plate 102 and a switch plate or mount 120 is stationary. Switches carried by switch mounts 118 and 120 constitute a means for monitoring the movements of the pusher plate 102 and for controlling further movements of the elevator plate 82. The switches carried by the switch mounts 118 and 120 are actuated when the pusher plate 102 has moved sufficiently to remove the stacks of reams from the elevator plate 82. Actuation of the switches carried by the switch mounts 118 and 120 causes a signal to be generated actuating the drive means for the elevator plate 82 and causing the latter to again move downwardly to the first receiving position. Retraction of the pusher plate 102 prior to return of the elevator plate 82 to its first receiving position is unnecessary. Reams accumulated on the plate 81, if of sufficient quantity, can immediately be shifted by the indexing arm 26 onto the elevator plate 82, irrespective of whether or not the pusher plate 102 has completed its return stroke.

Means for modifying the positioning of the stop finger 12 is provided. As seen in FIGS. 2 and 5, such means comprises a stop finger support bar 124 attached to a ream accumulator section frame 122, a stop finger adjusting screw 126, an adjusting screw nut 128, a flange bearing 130 and a finger adjusting support 132 connected to a stop adjustment shaft 148 by means of sprockets 150 and 158 and hand knobs 154 and 156.

In operation, when the desired number of reams are delivered onto the accumulator plate 81 causing the first or leading ream on the accumulator plate 81 to abut the stop plate 78 and close the switch 79, an electrical signal is transmitted to the hydraulic motor 76 which causes the shaft 66 and thus the lift cam 68 and transfer cam 70 to rotate. The first stage of rotation of the shaft 66 causes the indexing arm 26 to move horizontally to the left as seen in FIGS. 2 and 3 so as to push the desired number of reams 6 onto the elevator plate 82. There is no rotational component of movement of the indexing arm 26 during this initial stage of rotation of the shaft 66. As the hydraulic motor 76 continues to rotate the shaft 66, the lifter cam 68 will cause the indexing arm 26 to be raised so that, during the return stroke which then commences, the indexing finger 10 will be at a level above the new reams on the feed conveyor 2. Once the shaft 66 has completed a full revolution, a limit switch 162 will come into play, stopping the motor 76 until such time as another signal from the switch 79 is received when there is again a complete supply of reams.

When the reams are shifted onto the elevator plate 82, the monitoring means 94 detects the presence of such reams and actuates the hydraulic motor 86 of the elevator so as to lower the elevator plate 82 to the next receiving position. When succeeding reams are shifted onto the elevator plate 82, this sequence is repeated. When reams have been shifted onto the elevator plate 82 at the lowermost receiving position, further motion of the elevator plate will entail actuation of the monitoring means 98. Monitoring means 98 will in turn transmit a signal causing the motor 86 to reverse and raise the elevator plate 82 to a delivery position at a level above the first receiving position where a removing means in the form of the aforementioned pusher plate 102, actuated by limit switch 161 when the elevator plate 82 reaches the delivery position, will shift the stacks of reams off the elevator plate 82. Removal of the stacks from the elevator plate 82 by the removing means 102 will be monitored by switches carried on the mounts 118 and 120. Upon sufficient movement of the removing means 102 such that the stacks are removed, the switches carried by the switch mounts 118 and 120 will be actuated to start the motor 86 to lower the elevator plate 82 back to the first receiving position without awaiting return or retracting of the removing means 102 back to its original position.

The apparatus and method of the invention are susceptible of many modifications without departing from the spirit of the invention. Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for accumulating sheets into stacks, particularly for accumulating piles of sheets into larger stacks, comprising:

elevator means mounted for reciprocating, substantially vertical movement between a first receiving position, at least one succeeding receiving position disposed below the preceding receiving position by a distance approximately equal to the height of the piles of sheets being accumulated and a delivery position disposed above said first receiving position, wherein said elevator means comprises a plateform onto which piles of sheets are fed and a stop adjacent the platform and located in the path of movement of piles of sheets which are supplied to said elevator means to arrest such piles in predetermined positions on said platform;

first reversible drive means for lowering and raising said elevator means between said first and succeeding receiving positions and said delivery position;

means for feeding piles of sheets onto said elevator means when said elevator means is in said first and succeeding receiving positions so that piles of sheets accumulate on top of each other on said elevator means forming larger stacks of sheets on said elevator means, wherein said feeding means comprises a conveyor for seriatim delivery of piles of sheets, a plate coplanar with said conveyor and extending in a direction colinear with the path of movement of the piles, wherein said conveyor delivers piles of sheets onto said plate and the piles accumulate on said plate, an indexing arm for engaging each pile of sheets to be fed from said plate to said elevator means, a stop extending substantially transversely of the path of movement of the piles on said plate to arrest the piles in predetermined positions with respect to themselves and the elevator means, second drive means for first advancing said indexing arm so as to shift each pile in a sidewise direction onto said elevator means and for subsequently retracting said indexing arm back to its starting position, and means for rotating said indexing arm between a first position generally parallel to the plane of said plate, which first position is assumed when said second drive means is advancing said indexing arm, and a second position at an angle to the plane of said plate, which second position is assumed when said second drive means is retracting said indexing arm to its original position, wherein said second drive means comprises a drive rod connected at one end to said indexing arm, a stationary pivot shaft, a transfer cam lever pivotably mounted at one end of said pivot shaft and pivotally connected at the other end to the other end of said drive rod and transfer cam means mounted for rotary movement, said transfer cam means having a track and said transfer cam lever having a cam follower which rides within said track whereby rotation of said transfer cam means causes said transfer cam lever to pivot about said pivot shaft first in a counterclockwise direction, causing said drive rod to advance said indexing arm into engagement with the piles of sheets and to shift the piles, and thereafter in a clockwise direction, causing said drive rod to retract said indexing arm to its original position, wherein said rotating means comprises a first raising rod pivotally connected at one end to said indexing arm, an L-shaped raise crank pivotally connected at its apex to said drive rod and said transfer cam lever and at one end to the other end of said first raising rod, a second raising rod pivotally connected at one end to the other end of said raise crank, a raising cam rod pivotally connected at one end to the other end of said second raising rod, a stationary second pivot shaft, a raising cam lever pivotally mounted inwardly of its ends on said pivot shaft and pivotally connected at one end to the other end of said raising cam rod, an idler lever pivotally mounted at one end on said pivot shaft and pivotally connected at the other end to the one end of said raising cam rod and to the other end of said second raising rod and lifting cam means mounted for rotary movement, said lifting cam means having a track and said raising cam lever having a cam follower which rides within said track whereby rotation of said lifting cam means first causes said indexing arm to remain in its first position while said transfer cam lever pivots in a counterclockwise direction and thereafter causes said indexing arm to rotate and assume its second position while said transfer cam lever pivots in a clockwise direction, and wherein the underside of said indexing arm extends generally parallel to said plate and is cut out so that piles can be delivered beneath said indexing arm during the retraction stroke of said indexing arm;

means for controlling said indexing arm comprising means for monitoring the piles of sheets on said plate and for actuating said second drive means following detection of the desired number of piles of sheets on said plate so as to accumulate a desired number of piles of sheets on said plate prior to shifting of the piles by said indexing arm such that said indexing arm effects simultaneous delivery of multiple piles of sheets onto said elevator means;

means for removing the larger stacks of sheets from said elevator means when said elevator means is in said delivery position comprising a pusher plate for engaging the sides of stacks of sheets on said elevator means and for shifting them off of said elevator means, a storage conveyor onto which said stacks of sheets are shifted by said pusher plate, a transfer plate interposed between said elevator means when it is in the delivery position and said storage conveyor, and third drive means for first advancing said pusher plate so as to shift the stacks off of said elevator means and then retracting said pusher plate back to its original position; and second means for controlling said first reversible drive means comprising second means for monitoring the feeding of piles of sheets onto said elevator means by said feeding means when said elevator means is in said first and succeeding receiving positions and for actuating said first drive means so as to lower said elevator means to the next succeeding receiving position after each time feeding of piles is detected, third means for monitoring movement of said elevator means a nd for reversing said first drive means so as to raise said elevator means to the delivery position following detection that said elevator means has moved below the lowermost receiving position, wherein said delivery position is located above said stop and said removing means removes stacks of sheets from the platform in the same direction in which they were delivered onto the platform by said feed means, and fourth means for monitoring movement of said removing means and for actuating said drive means so as to lower said elevator means back to said first receiving position following detection that said removing means has moved a sufficient amount to effect removal of the larger stacks from said elevator means.

2. Apparatus for accumulating piles of sheets into stacks, particularly for accumulating reams of paper sheets into stacks of reams, comprising a source of piles; feed conveyor means for advancing a file of piles from said source at a predetermined level and along a predetermined elongated path; elevator means adjacent to a portion and disposed at one side of said path; means for moving said elevator means between a first position at said level, at least one second position below said level and a third position above said level; means for shifting predetermined numbers of piles from the leader of the file in said path onto said elevator means in a direction transversely of said path first in the first and thereupon in the at least one second position of said elevator means so that the piles which are shifted in the second position of the elevator means come to rest on the piles already on said elevator means and form larger stacks therewith; means for operating said moving means so as to move said elevator means and the larger stacks thereon to said third position after the elevator means reaches said second position and to thereupon move said elevator means to said first position and said at least one second position; and means for removing larger stacks from said elevator means in the third position of said elevator means.

3. The apparatus of claim 2, wherein said shifting means comprises an indexing member and drive means for moving said indexing member transversely of said path in a first direction from a starting position to thereby shift a predetermined number of piles from said path onto said elevator means and thereupon in a second direction counter to said first direction to retract the indexing member to the starting position.

4. The apparatus of claim 3, wherein the starting position of the indexing member is at the other side of said path opposite said elevator means.

5. The apparatus of claim 3, wherein said indexing member comprises a portion which is arranged to move along a first path and to thereby shift a predetermined number of piles from said predetermined path into said elevator means during movement of said indexing member from its starting position and said drive means includes means for moving said portion of said indexing member along a different second path during return movement of said indexing member to starting position so that said portion of the indexing member bypasses the predetermined path and the feed path during return movement of said indexing member to its starting position.

6. The apparatus of claim 3, wherein said indexing member includes a portion which bridges said predetermined path during return movement of said indexing member to its starting position so that said feed conveyor means is free to advance piles along said predetermined path.

7. The apparatus of claim 3, wherein said drive means comprises a first cam-operated unit for reciprocating said indexing member and a second cam-operated unit for turning said indexing member during movement back to its starting position.

8. The apparatus of claim 3, further comprising accumulator means arranged to receive the leader of the file of piles from said feed conveyor means and disposed between said indexing member and said elevator means.

9. The apparatus of claim 8, further comprising stop means located in the path of movement of the foremost pile on said accumulator means and means for actuating said drive means on engagement of a pile with said stop means.

10. The apparatus of claim 9, wherein said actuating means includes means for actuating said drive means when said accumulator means supports a preselected number of piles.

11. The apparatus of claim 2, wherein said operating means comprises means for monitoring the movements of said elevator means.

12. The apparatus of claim 2, wherein said removing means comprises a reciprocable pusher movable from a retracted to an extended position to thereby remove stacks from said elevator means and back to said retracted position.

13. The apparatus of claim 12, wherein said operating means comprises means for actuating said moving means so as to lower said elevator means from the third to the first position while said pusher dwells in the extended position.

14. The apparatus of claim 2, further comprising a storage conveyor, said removing means including means for delivering stacks of piles from said elevator means onto said storage conveyor.

15. The apparatus of claim 14, further comprising means for intermittently driving said storage conveyor.

16. The apparatus of claim 14, further comprising transfer means interposed between said elevator means and said storage conveyor to support the stacks during advancement from said elevator means onto said storage conveyor.

17. The apparatus of claim 2, wherein said elevator means comprises a platform and stop means adjacent to said platform to arrest the piles which are advanced onto said platform by said shifting means.

18. The apparatus of claim 17, further comprising means for adjusting the position of said stop means with reference to said platform.

19. The apparatus of claim 2, wherein said shifting means includes means for moving piles from said path onto said elevator means in a predetermined direction and said moving means comprises means for removing stacks from said elevator means in said predetermined direction.

20. The apparatus of claim 2, further comprising means for monitoring the positions of said removing means and for transmitting signals to said moving means.

21. A method of accumulating piles of sheets, particularly reams of paper sheets, into stacks of piles, comprising the steps of feeding a file of piles along a first path to a predetermined level; establishing a second path adjacent to a portion and located at one side of said first path and moving the second path between a first level corresponding to the predetermined level, at least one second level below the first level and a third level above the first level; shifting predetermined numbers of piles from the leader of the file transversely of said first path and into the second path at the first level and thereupon at the second level of the second path so that the piles in the second path accumulate into stacks of superimposed piles; raising the second path and the stacks of superimposed piles to the third level; and removing the stacks of superimposed piles from the second path at the third level.

22. The method of claim 21, further comprising the step of resuming the feeding of piles along the predetermined path during the interval between the shifting of piles into the second path while the second path is disposed at and between the first and second levels.

23. The method of claim 21, further comprising the steps of returning the second path from the third to the first level and resuming the shifting of piles from the first path into the second path.

24. The method of claim 21, further comprising the step of accumulating said predetermined numbers of piles at a station adjacent to said predetermined path prior to shifting of the thus accumulated predetermined numbers of piles into the second path.

25. The method of claim 21, further comprising the step of storing the stacks of piles which are removed from the second path at the third level of the second path.

26. The method of claim 21, further comprising the steps of monitoring the levels of the second path for the purpose of initiating movements of the second path from the first level to the second level, to the third level, back to the first level and so forth.

* * * * *